United States Patent [19]

Kolton et al.

[11] Patent Number: 5,002,210

[45] Date of Patent: Mar. 26, 1991

[54] MULTIPLE GARMENT HANGER FOR SNAP ON USE WITH A ROD

[75] Inventors: Chester Kolton, Westfield; Stuart S. Spater, Livingston, both of N.J.

[73] Assignee: B&G Plastics, Inc., New York, N.Y.

[21] Appl. No.: 386,407

[22] Filed: Jul. 26, 1989

[51] Int. Cl.[5] ..... A47G 25/34; A47G 25/44; A47G 25/14

[52] U.S. Cl. ..... 223/91; 223/88; 223/85; 223/96

[58] Field of Search ..... 211/113, 116, 118; 223/85, 88, 90, 91, 92, 93, 95, 96

[56] References Cited

U.S. PATENT DOCUMENTS

| | | | |
|---|---|---|---|
| 614,667 | 1/1898 | Pritchette | 223/85 |
| 712,475 | 11/1902 | Barnard | 223/85 |
| 769,694 | 9/1904 | Geisert | 223/85 |
| 1,914,840 | 6/1933 | Wolff | 223/88 |
| 2,111,772 | 3/1938 | Guillot | 223/88 |
| 3,738,549 | 6/1973 | Driscoll | 223/85 |

*Primary Examiner*—Werner H. Schroeder
*Assistant Examiner*—Bibhu Mohanty
*Attorney, Agent, or Firm*—Robin, Blecker, Daley & Driscoll

[57] ABSTRACT

A garment hanger releasably secured to a display rod which comprises an integral body member defining a central portion having a detent for releasably securing the hanger to the display rod and first and second wing portions extending respectively oppositely from the central portion, the central portion defining a stabilizer extending generally orthogonally to the wing portions and outwardly thereof for maintaining the wing portions and the central portion in non-tilted relation with respect to the display rod upon attachment of the garment to the wing portions. In that the central portion of the hanger interiorly defines the releasable securement detent, the hanger of the invention does not require a extending hook portion, thus enhancing garment hanging density.

11 Claims, 3 Drawing Sheets

MULTIPLE GARMENT HANGER FOR SNAP ON USE WITH A ROD

FIELD OF THE INVENTION

This invention relates generally to garment hangers and pertains more particularly to improved hangers for garments such as panties and bras.

BACKGROUND OF THE INVENTION

Panty and bra hangers heretofore known have involved an integral body member defining a hook portion and a central portion therebelow supporting first and second wing portions extending respectively oppositely from the central portion and having end portions for the releasable receipt of panties and/or bras.

Such prior art hangers are seen to have various disadvantages. The presence of the hook portion places an increased display height space requirement, since it extends upwardly of the central and wing hanger portions and consumes otherwise usable display space. Absence of the extending hook would enhance display density for products. Further, since the garments, particularly the bra, hangs asymmetrically aside the hanger, there is an aesthetically undesirable aspect to the prior art hangers, namely, a tilting thereof about the display rod.

SUMMARY OF THE INVENTION

It is a primary object of the present invention to provide improved garment hangers.

A more particular object of the invention is the provision of garment hangers which overcome the foregoing disadvantages of prior art hangers.

A more specific object of the invention is the provision of improved panty and bra hangers permitting enhanced display density for the products and averting the tilting of hung products with respect to display rods.

In attaining the foregoing and other objects, the invention provides a garment hanger releasably secured to a display rod and comprising an integral body member defining a central portion having a detent for releasably securing the hanger to the display rod and first and second wing portions extending respectively oppositely from the central portion, the central portion defining stabilizer structure extending generally orthogonally to the wing portions and outwardly thereof for maintaining the wing portions and the central portion in non-tilted relation with respect to the display rod upon attachment of the garment to the wing portions.

In that the central portion of the hanger interiorly defines the releasable securement detent, the hanger of the invention does not require a hook portion, thus enhancing garment hanging density.

Further, the stabilizer structure enhances non-tilt garment hanging and, to this extent, comprises in its preferred configuration an arcuate member extending contiguously with the central portion and of open circular configuration, defining a flat sector in registry with the central portion. The central portion is also of open circular configuration, defining a flat sector in registry with the arcuate member flat sector.

The foregoing and other objects and features of the invention will be further understood from the following detailed description of a preferred embodiment thereof and from the drawings wherein like reference numerals identify like parts and components throughout.

BRIEF DESCRIPTION OF THE DRAWINGS

FIG. 6(*a*) is a detailed view of the wing end portions of the prior art bra hanger of FIG. 6.

DETAILED DESCRIPTION OF PREFERRED EMBODIMENTS AND PRACTICES

Figure 2:
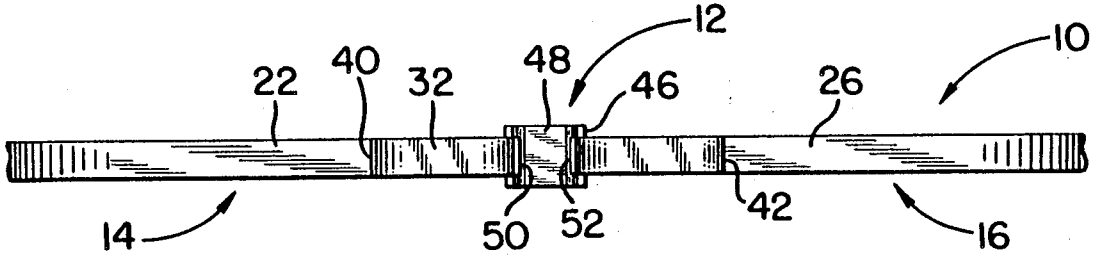
FIG. 2 is a top plan view of the FIG. 1 showing.
Figure 1:
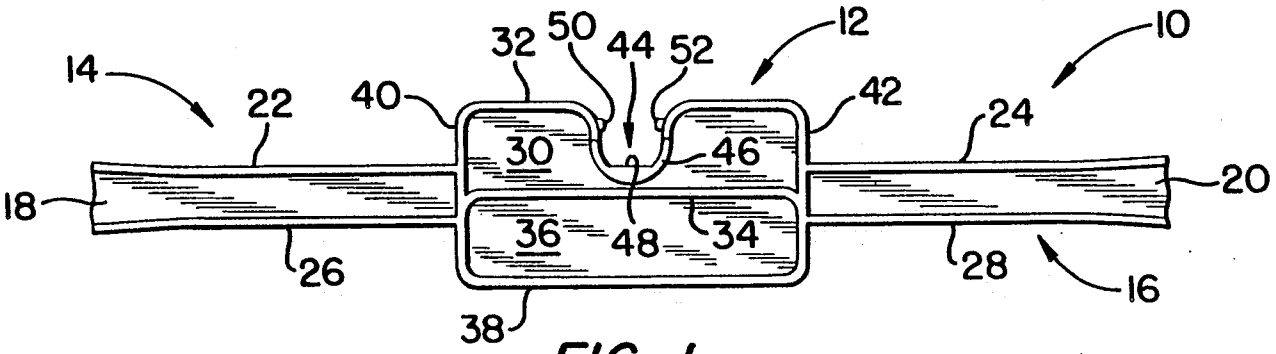
FIG. 1 is a front elevation of a hanger in accordance with the invention with its end portions omitted.
Figure 3:
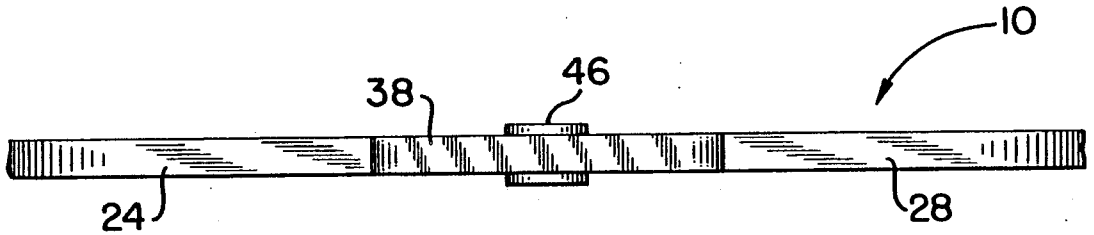
FIG. 3 is a bottom plan view of the FIG. 1 showing.

Referring to FIGS. 1–3, partial hanger 10 of the invention is a molded body of plastic or the like having a central portion 12 and wings 14 and 16 extending respectively oppositely and laterally of portion 12. Wings 14 and 16 are structured as I-beams, including channel members 18 and 20, upper flanges 22 and 24 and lower flanges 26 and 28. Central portion 12 is of stacked I-beam configuration, having an upper channel member 30 with upper flange 32 and lower flange 34 and a lower channel member 36 sharing flange 34 as its upper flange and having lower flange 38. Side flanges 40 and 42 provide a continuous perimeter for central portion 12 with flanges 32 and 38. The channel members share a common plane, i.e., the central plane of the partial hanger, and are of width about one-half of the width of the flanges.

An opening 44 is formed in central portion 12, centrally of portion 12 and wing portions 14 and 16, and is bounded by flange 32 and by stabilizer 46 which extends outwardly of flange 32, such boundary being generally circular, stabilizer 46 providing a flat sector 48 at the bottom of opening 44. Projections 50 and 52 are formed in flange 32 adjacent to the entry to opening 44.

Figure 4:
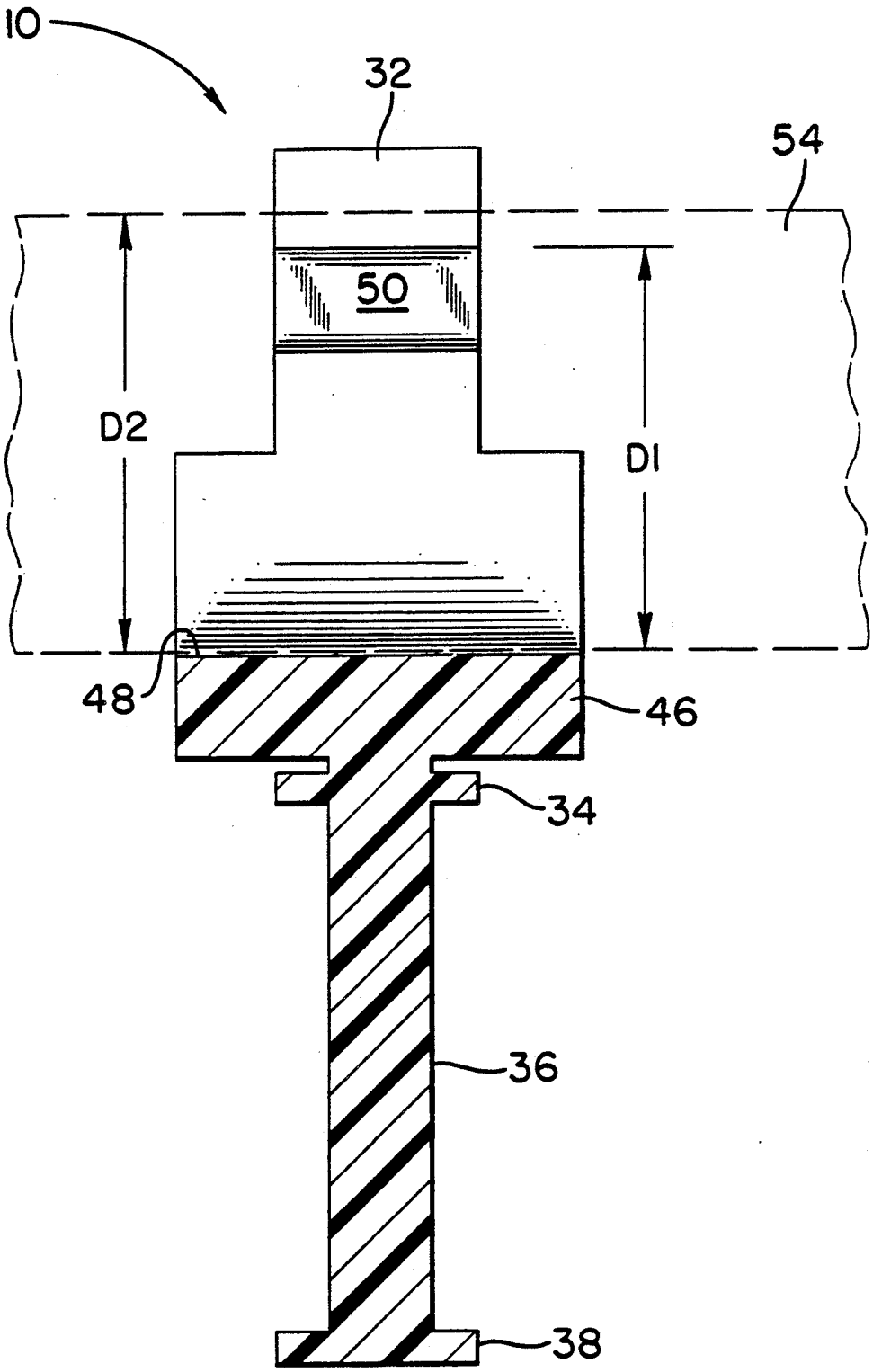
FIG. 4 is an enlarged sectional view of the FIG. 1 hanger as would be seen from plane IV—IV of FIG. 1.

Referring to the sectional view of FIG. 4, a display rod 54 is shown in phantom lines in assembly with partial hanger 10 retained between projection 50 and stabilizer flattened sector 48, the vertical spacing D1 between projection 50 (and projection 52) and sector 48*b* being selected to be slightly less than the diameter D2 of display rod 54 to effect such retention. Partial hanger 10 is releasably joinable to display rod 54, the latter being forced beyond projections 50 and 52, as permitted by the resiliency of the plastic of the partial hanger body, into opening 44.

Figure 5:
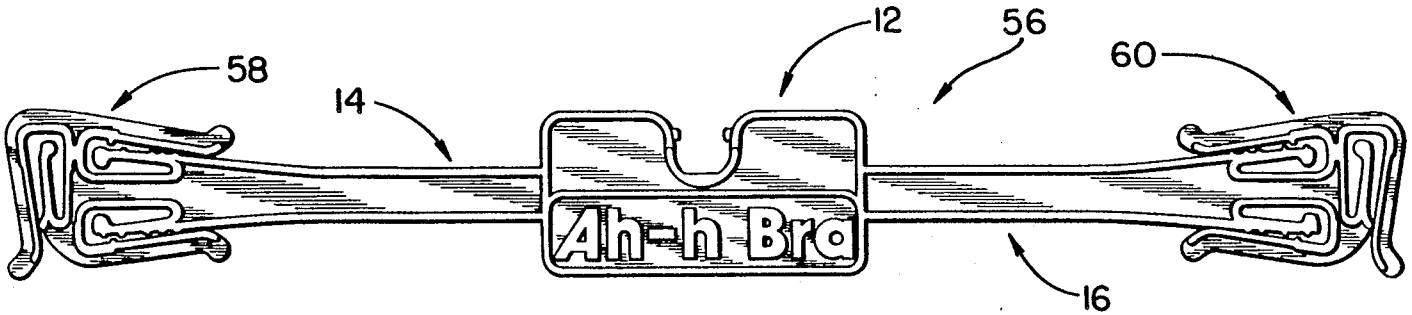
FIG. 5 is a front elevation of a hanger in accordance with the invention with end portions included.

In FIG. 5, partial hanger 10 is depicted as complete hanger 56 with central portion 12, wing portions 14 and 16, and wing end portions 58 and 60, which will be recognized as heretofore known wing end portions of hook-type hangers used in the hanging of panties and brassieres. In the latter respect, reference is made to U.S. Pat. No. 3,738,549, issued on June 12, 1973 and entitled "Brassiere Hanger and Display System" and assigned on its face to Warnaco, Inc. of Bridgeport, Conn., hereby incorporated by this reference thereto.

Figure 6A:
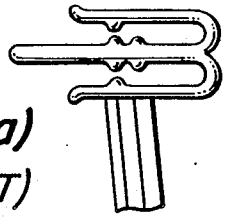
FIG. 6(a) (PRIOR ART)
FIG. 6 is a perspective view of a prior art bra hanger shown in conjunction with a display rod.
Figure 6:
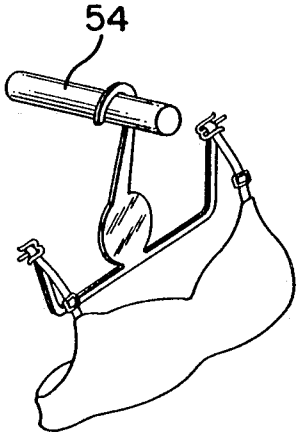
FIG. 6 (PRIOR ART)

FIG. 6 is a repeat showing in part of FIG. 12 of the '549 patent, with omission of the reference numerals thereof and with the inclusion of display rod 54. FIG. 6(*a*) repeat showing of FIG. 6 of the '549 patent, with omission of reference numerals, the showing being of the detailed structure of a strap-receiving member or clip thereof. As will be evident, since the bra is an asymmetric load on the display rod and hanger, a necessary tilting of the hanger occurs. Further, as above noted, hanging density is adversely affected by the presence of the hanger hook portion.

To the contrary, in accordance with the present hanger structure, per FIG. 4, despite the asymmetry of the load presented to hanger 56, i.e., being predominately to one side thereof as in the case of the prior art hanger of FIG. 6, the presence of stabilizer 46 insures that the load does not impart a tilt to the hanger. Thus, as will now be appreciated, stabilizer 46, and more particularly the flattened sector presented thereby to the display rod precludes rotational movement of hanger 56 relative to the display rod, such as would occur in the absence of the stabilizer.

The stacked I-beam configuration of central portion 12 effectively divides the central portion into an upper functional area for non-tilting securement to the display rod, irrespective of asymmetrical loading, and a lower area for the display of garment size or logo, as is indicated by the legend shown in FIG. 4 in such lower area "Ah-h Bra".

Figure 7:
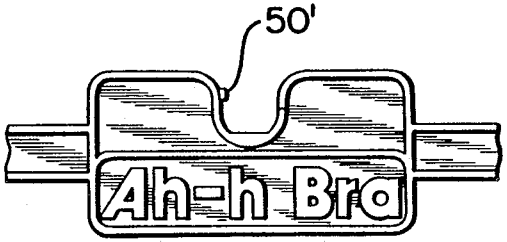
FIG. 7 is a partial front elevation of a modified hanger in accordance with the invention.

Various changes may be introduced to the foregoing particularly depicted and described embodiments and modifications may be made as against the described practices without departing from the invention. Thus, the partial hanger may evidently be equipped with end portions of character diverse from the particularly shown bra and panty hanging end portions. Further, as is shown in FIG. 7, the hanger of the invention may include but a single detent 50', as contrasted with the plural detents 50 and 52 of the previously discussed embodiment, facilitating release of the hanger from the display rod and yet providing secure retention thereof and enjoyment of the foregoing described stabilizing hanging of the garments. Accordingly, it is to be understood that the particularly shown and discussed preferred embodiments and practices are intended in an illustrative and not in a limiting sense. The true spirit and scope of the invention is set forth in the ensuing claims.

What is claimed is:

1. A garment hanger releasably securable to a display rod and comprising an integral body member defining a central portion having an uppermost surface and a detent for releasably securing said hanger to said display rod, said detent opening into said uppermost surface and extending downwardly into said central portion and first and second wing portions extending respectively oppositely from said central portion, said central portion defining a stabilizer continuous with said detent and extending generally orthogonally and outwardly of said central portion.

2. The invention claimed in claim 1 wherein said stabilizer means comprises an arcuate member extending contiguously with said central portion.

3. The invention claimed in claim 2 wherein said arcuate member is of open circular configuration, defining a flat sector in registry with said central portion.

4. The invention claimed in claim 3 wherein said detent is of open circular configuration, said central portion defining a flat sector in registry with said arcuate member flat sector.

5. The invention claimed in claim 4 wherein said central portion defines at least one projection extending into said detent from said open circular configuration thereof.

6. The invention claimed in claim 1 wherein said stabilizer means comprises first and second arcuate members extending contiguously with said central portion in respective opposite directions from said central portion.

7. The invention claimed in claim 6 wherein each of said first and second arcuate members is of open circular configuration, defining a flat sector in registry with said central portion.

8. The invention claimed in claim 7 wherein said detent is of open circular configuration, said central portion defining a flat sector in registry with each of said flat sectors of said arcuate members.

9. The invention claimed in claim 8 wherein said central portion defines projections extending into said detent from said open circular configuration thereof.

10. A garment hanger releasably securable to a display rod and comprising an integral body member defining a central portion having a detent for releasably securing said hanger to said display rod and first and second wing portions extending respectively oppositely from said central portion, said central portion defining first and second arcuate members extending contiguously with said detent in respective opposite directions from said central portion, each of said first and second arcuate members being of open circular configuration, and each defining a flat sector in registry with said detent, said detent being of open circular configuration, said central body defining a flat sector in registry with each of said flat sectors of said first and second arcuate members.

11. The invention claimed in claim 10 wherein said central portion defines at least one projection extending into said detent from said open circular configuration thereof.

* * * * *